United States Patent [19]

Kogos et al.

[11] 4,032,076

[45] June 28, 1977

[54] APPARATUS FOR CONTINUOUS WINDING OF FILAMENT ON SPOOLS

[76] Inventors: Aizik Markovich Kogos, ulitsa F.Poletaeva, 24, korpus 2, kv. 50, Moscow; Flegont Andreevich Kolchanov, prospekt Lenina, 14, kv. 14, Balashikha-1 Moskovskoi oblasti; Adolf Alexeevich Gnedov, ulitsa Lukhovitskaya, 3, kv. 5, Moscow; Valery Alexandrovich Vinogradov, Ryazansky prospekt, 91, kv. 77, Moscow; Mark Abramovich Labkovsky, Novogireevskoe shosse, 16, kv. 16, Moscow; Sergei Alexandrovich Filatov, Zeleny prospekt, 23/43, kv. 54, Moscow; Vladimir Mikhailovich Kolesov, ulitsa Kirova, 89, kv. 10, Alma-Ata; Oleg Kirillovich Khrapchenkov, ulitsa Butyrskaya, 3, kv. 45, Moscow; Alexandr Nikolaevich Semes, Kvartal 20, 89, kv. 10, Shelikhov Irkutskoi oblasti, all of U.S.S.R.

[22] Filed: June 28, 1976

[21] Appl. No.: 700,140

[52] U.S. Cl. ..... 242/25 A; 242/79

[51] Int. Cl.[2] ..... B65H 67/04

[58] Field of Search ..... 242/25 A, 25 R, 18 A, 242/18 R, 79, 41, 35.5 A, 58.6

[56] References Cited

UNITED STATES PATENTS

| | | | |
|---|---|---|---|
| 2,738,138 | 3/1956 | Russell | 242/79 |
| 2,848,124 | 8/1958 | Angell et al. | 242/79X |
| 3,032,289 | 5/1962 | Fredricksson et al. | 242/79 |
| 3,174,700 | 3/1965 | Lemaire | 242/18 A |
| 3,348,785 | 10/1967 | Cocke | 242/79 X |
| 3,393,881 | 7/1968 | Nash | 242/79 |
| 3,462,094 | 8/1969 | Shumaker | 242/79 |
| 3,690,583 | 9/1972 | Herman | 242/79 X |
| 3,822,044 | 7/1974 | Riekkinen | 242/79 |
| 3,858,817 | 1/1975 | Riekkinen | 242/25 A |
| 3,877,653 | 4/1975 | Foltyn et al. | 242/25 A |

*Primary Examiner*—Stanley N. Gilreath
*Attorney, Agent, or Firm*—Lackenbach, Lilling & Siegel

[57] ABSTRACT

An apparatus for continuous winding of filament on spools comprises a winder means including pairs of fixed and movable centers and a means for feeding spools to and removing them from the centers which is in force transmitting connection with the winder means and has a carriage mounted in guides which are arranged under the centers and extend normally thereto. The carriage is adapted to carry a spool and lift it up to the centers, as well as to remove a spool from the centers due to the provision of a force transmitting connection between each of the movable centers and the carriage. Thus an opportunity is provided for enabling a complete manufacturing line resulting in an improved productivity of the apparatus.

11 Claims, 14 Drawing Figures

APPARATUS FOR CONTINUOUS WINDING OF FILAMENT ON SPOOLS

The present invention relates to winding equipment, and, more particularly, to apparatus for continuous winding of filament on spools, e.g. for winding wire after the drawing mills in automatic production lines.

The invention may also be advantageously used in cable manufacture.

The apparatus according to the invention is preferably designed for winding filament on spools having a cheek diameter greater than 400 mm.

Known in the art are apparatus for continuous winding of filament on spools cf. Japanese Pat. No. 47-48821) comprising a winder means comprising pairs of fixed and movable centers for parallel arrangement of spools which is in a force transmitting connection with a traversing mechanism and a mechanism for transferring the filament from one spool to another as well as a device for feeding spools to and removing them from the centers, feeding and receiving platforms.

In said apparatus, the winder means is provided with two pairs of centers for parallel arrangement of spools which are arranged adjacent to each other. Magazines for empty spools are provided on the outer side of each of these pairs.

Means for feeding spools to and removing them from the centers comprises two oppositely mounted mechanisms.

Each of the mechanisms comprises a container and a receiving platform, an empty spool being fed from a respective magazine to the receiving platform by means of the container. The receiving platform is arranged under a corresponding pair of centers at a distance therefrom which is substantially equal to one-half the diameter of the spool cheek.

The receiving platform is rotatable at a certain angle in the plane extending normally to the center axis by means of an independent drive. The centers are moved towards each other to receive the spool from the platform.

The container is displaced by means of an independent drive and has a retractile wall making it possible for an empty spool to be transferred to the receiving platform. After the spool is loaded, the movable center is retracted, and the spool is lowered down to the receiving platform, first with one cheek and then with the other cheek. In many cases the other cheek remains engaged with the fixed center. Thus the spool may be placed on the receiving platform in an inclined position. A ramp is provided laterally of the receiving platform for receiving the loaded spool from the receiving platform. There is a rotary platform at the end of the ramp which feeds the spool to a stationary platform wherefrom the spool is removed.

Thus, the feeding of an empty spool to each pair of centers and the removal of a loaded spool therefrom are carried out from opposite sides of the apparatus.

The provision of several identical mechanisms for feeding spools to and removing them from the centers results in a complicated construction of the apparatus and makes it difficult to service during-operation.

Feeding empty spools to each pair of centers and removing loaded spools on opposite sides of the apparatus preclude the possibility of providing a single production flow in the drawing line so that the productivity of the line cannot be considerably improved.

In the device for feeding spools to and removing them from the centers, the mechanism for feeding an empty spool is arranged above the winder means and the mechanism for removing a loaded spool is arranged below this means. This arrangement results in a multiple-level combersome construction of an apparatus which would have a comparatively large size.

The prior art apparatus is also deficient in that it does not ensure reliable removal of loaded spools from the fixed center so that a spool may be placed on the receiving platform in an inclined position thus resulting in the interruption of the operating cycle of the apparatus and, hence, of the entire drawing line.

In addition, where the inclined position of a spool on the receiving platform is not detected in proper time, the spool may fall down therefrom, and an emergency situation will arise.

It is the main object of the present invention to provide an apparatus for continuous winding of filament on spools having a device for feeding spools to and removing them from the centers which enables the organization of a single continuous production flow thereby considerably improving the productivity of the apparatus.

Another not less important object of the invention is to eliminate the provision of identical mechanisms thus resulting in simplification of structure, smaller size and much easier operation and maintenance of the apparatus.

These objects are accomplished in an apparatus for continuous winding of filament on spools comprising a winder means consisting of pairs of fixed and movable centers for parallel arrangement of spools which is in a force transmitting connection with a traversing mechanism and a mechanism for transferring filament from one spool to another, as well as a device for feeding spools to the centers and for removing them to a receiving platform according to the invention, the device for feeding spools to and removing them from the centers comprises a carriage having a top part and a bottom part, the bottom part being vertically split and being mounted in guides extending under and normally to the centers and the top part consisting of three superposed plates of which a first plate is mounted on the bottom part of the carriage, a second or intermediate plate is articulated to the first plate with one side thereof for rotation in a vertical plane extending parallel to the guide and supports guides members extending parallel to a pivot of articulation, and a third plate is arranged in the guide members and is adapted for accommodation of spools, the third plate having means for locking its position relative to the intermediate plate and being in a force transmitting connection with one of the movable centers when the top part of the carriage is in the uppermost position.

This construction of the device for feeding spools to and removing them from the centers minimizes the number of identical mechanisms thus greately simplifying the structural arrangement of the apparatus as a whole and reducing its size.

The arrangement of the mechanisms for feeding filament on one side and the mechanisms for feeding empty spools and removing loaded spools on the other side of the apparatus enables the provision of a single production flow, hence a considerable improvement of the productivity of the apparatus and the drawing line as a whole.

The provision of the top part of the carriage composed of three superposed plates movable relative to one another enables the positioning of spools relative to the centers, and the provision of the split bottom part of the carriage makes it possible to effect feeding of spools to and removing them from the centers in the vertical direction thereby providing an opportunity of accommodating the device for feeding spools to and removing them from the centers below the floor level.

This facility reduces the number of stages of the apparatus and lowers the overall height thereof above the floor level.

The provision of means for locking the position of the third top plate relative to the intermediate plate determines the position of the third plate during the transfer of the spools from the winder means to the unloading station, and vice versa.

The locking of the position of the third top plate is required to ensure a predetermined position thereof at the moments of reception of a loaded spool from the centers in the container and installation of an empty spool in the centers.

Failure to comply with this requirement may hamper the installation of an empty spool in the center, and, upon the removal, a loaded spool may not occupy a predetermined position on the third plate which may result in its falling down from the carriage thus leading to an emergency situation.

The provision of a force transmitting connection between the top plate of the carriage and each of the movable centers ensures the reliable removal of a loaded spool from the fixed center thus eliminating the inclined positioning of the spool on the third top plate.

According to the invention, the bottom part of the carriage is made composite of two vertical cups received in each other with their open ends for relative axial reciprocations, the lower cup being mounted in guides, and the first plate of the top part of the carriage being rigidly fixed to the bottom wall of the upper cup. According to the invention, the axial displacement of the cups is effected by means of a hydraulic cylinder mounted therein, the housing of the cylinder being mounted to the bottom wall of the lower cup and the free end of a piston rod being fixed to the bottom wall of the upper cup.

This construction enables the feeding of spools to the centers by smoothly displacing the top part of the carriage in the vertical direction with a required accuracy.

Means for locking the position of the third top plate relative to the intermediate plate preferably comprises two vertical rods of which a first rod is mounted in a cup secured to the intermediate plate and axially urged by a spring towards the third top plate, and a second rod extends in a hole made in a projection of the third top plate to cooperate, with the lower end, with the upper end of the first rod, a plate mounted in a groove of the upper end of the projection being secured to the upper end of second rod.

The third top plate of the top part of the carriage is preferably made V-shaped and formed of two plates rigidly interconnected by means of two V-shaped ridges, a stepped bar being secured adjacent to the edge of one of the plates to extend in the direction normal to the guides supporting the third top plate. This construction of the third plate ensures a given position of a spool on the plate and prevents it from rolling down during the transfer.

According to the invention, the force transmitting connection between the third top plate of the carriage and each of the movable centers is provided by means of a drawbar which is fixed to the movable center with one end and is supported on the plate of said means for locking the position of the top plate of the carriage relative to the intermediate plate with the other end.

The third top plate of the carriage is preferably provided with a rotatable spring-loaded stop for fixing a spool on the top plate during the transfer.

According to the invention, the intermediate plate is provided with a roller cooperating with a cam fixed to the receiving platform for rotating the intermediate plate. This provides a force transmitting connection between the carriage and the receiving platform.

The receiving platform is preferably stationary fixed on a slide block to which there is also articulated a feeding platform, the slide block being mounted for reciprocation in guides extending parallel to the centers.

The apparatus is preferably provided with a hydraulic cylinder having its piston rod connected to the slide block for effecting reciprocation in the guides, the piston rod being in a force transmitting connection with the feeding platform by means of a roller fixed to the feeding platform and a connecting rod articulated to the end of said piston rod and telescopically connected to a lever articulated to the slide block and cooperating with the roller.

This construction enables the use of the carriage for feeding empty spools and removing loaded spools thus organizing a single production flow.

The invention will now be described in detail with reference to a specific embodiment thereof illustrated in the accompanying drawings, in which.

Figure 1:
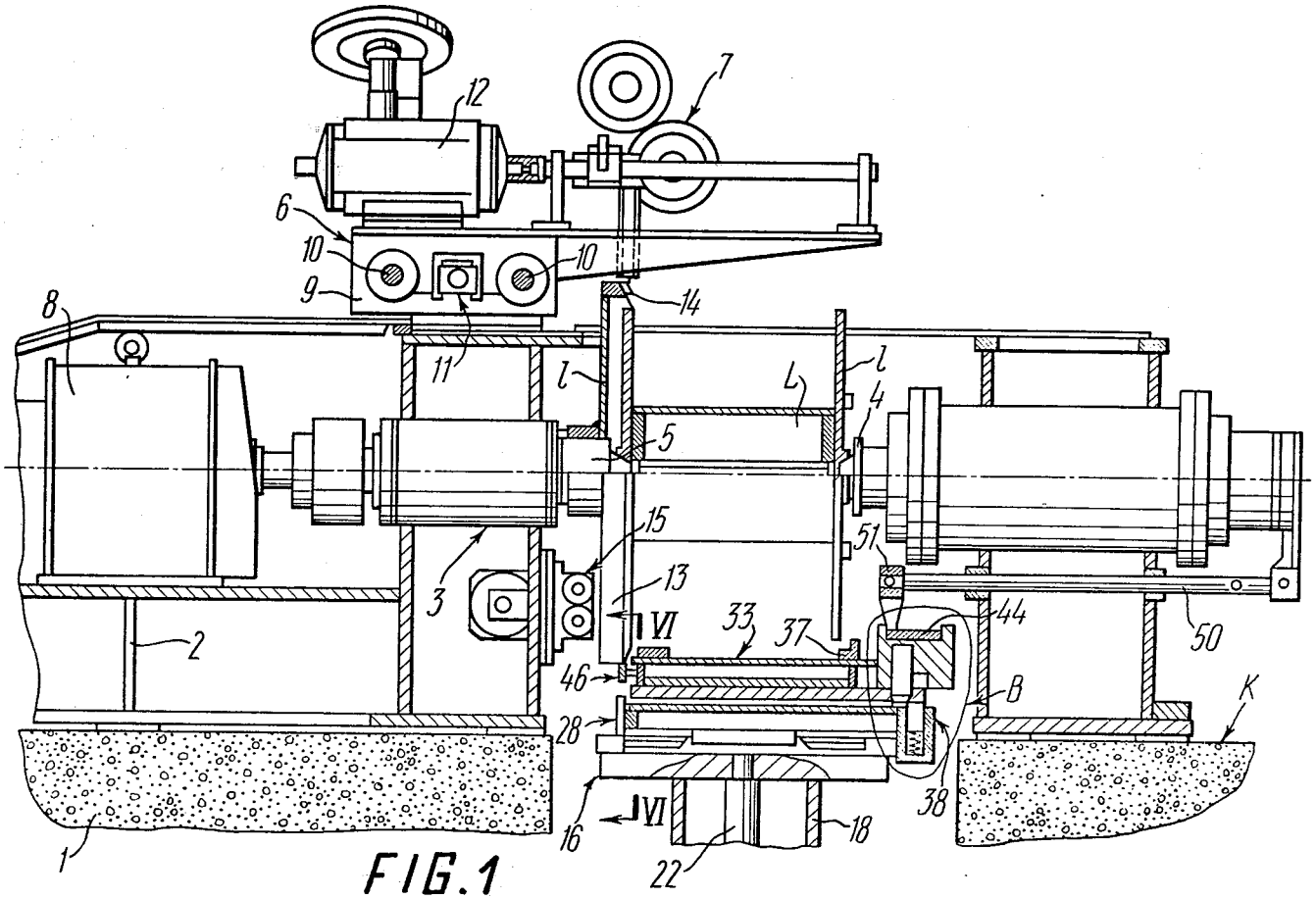
FIG. 1 is a side elevation view, partially in section, of an apparatus for continuous winding of filament on spools according to the invention.

The apparatus for continuous winding of filament on spools comprises a base 2 mounted on a foundation 1 (FIG 1). The base 2 supports a winder means 3 including two pairs of movable centers 4 and fixed centers 5 for parallel arrangement of spools L. It should be noted that the pairs of centers 4 and 5 can be rapidly replaced and are mounted in conventional manner so that their axes extend parallel to one another. A mechanism 6 for transferring filament from one spool L to another is mounted above the centers 4 and 5, and this mechanism supports a traversing mechanism 7 for laying filament on the spool L. Each axially fixed center 5 has an independent drive 8 for rotating it which is also mounted in the base 2.

The filament transfer mechanism 6 comprises a carriage 9 displaceable in guides 10 by means of a screw-and-nut mechanism 11 and an independent drive (not shown).

The traversing mechanism 7 is mounted on the carriage 9 and is controlled by a step motor 12.

A disc 13 having means for engaging the filament is mounted on each fixed center 5 coaxially therewith.

A mechanism 15 for feeding filament to the means 14 for engaging filament is mounted on the base 2 between the discs 13 of the adjacent fixed centers 5.

The means 14 and mechanism 15 may be of any conventional design and will not be disclosed in details wherein in order not to shade the description of the invention.

Figure 2:
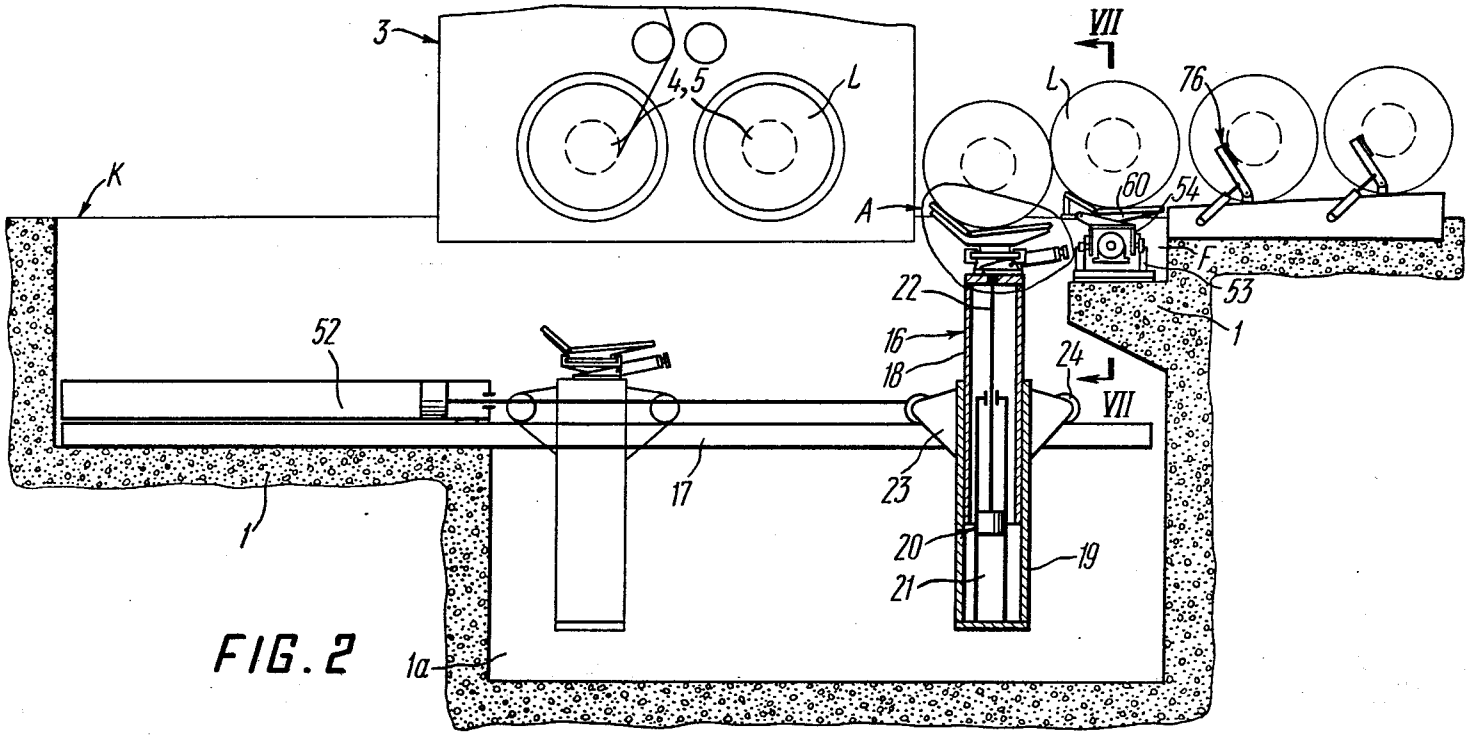
FIG. 2 is a front elevation partially in section of the apparatus according to the invention.

A device for feeding the spools L to and removing them from the centers 4 and 5 is located under the base 2 below the floor level "K" in a foundation recess la (FIG. 2).

This device comprises a carriage 16 (FIG. 2) mounted in guides 17 which extend under and normally to the centers 4 and 5.

The carriage 16 has a top part and a bottom part. The bottom part of the carriage 16 is made composite and consists of two vertical cups 18 and 19. The upper cup 18 is received with the open and thereof in the lower cup 19 to reciprocate in the axial direction. The reciprocations are effected by means of a hydraulic cylinder 20 mounted within said cups 18, 19 coaxially therewith. The housing 21 of the hydraulic cylinder 20 is mounted with the lower end thereof to the bottom wall of the lower cup 19. The free end of a piston rod 22 is fixed to the bottom wall of the upper cup 18.

The upper end of the lower cup 19 has brackets 23. Rollers 24 are mounted in the brackets on axles normal to the cup axes, and the bottom part of the carriage 16 is mounted in the guides 17 by means of these rollers.

Figure 3:
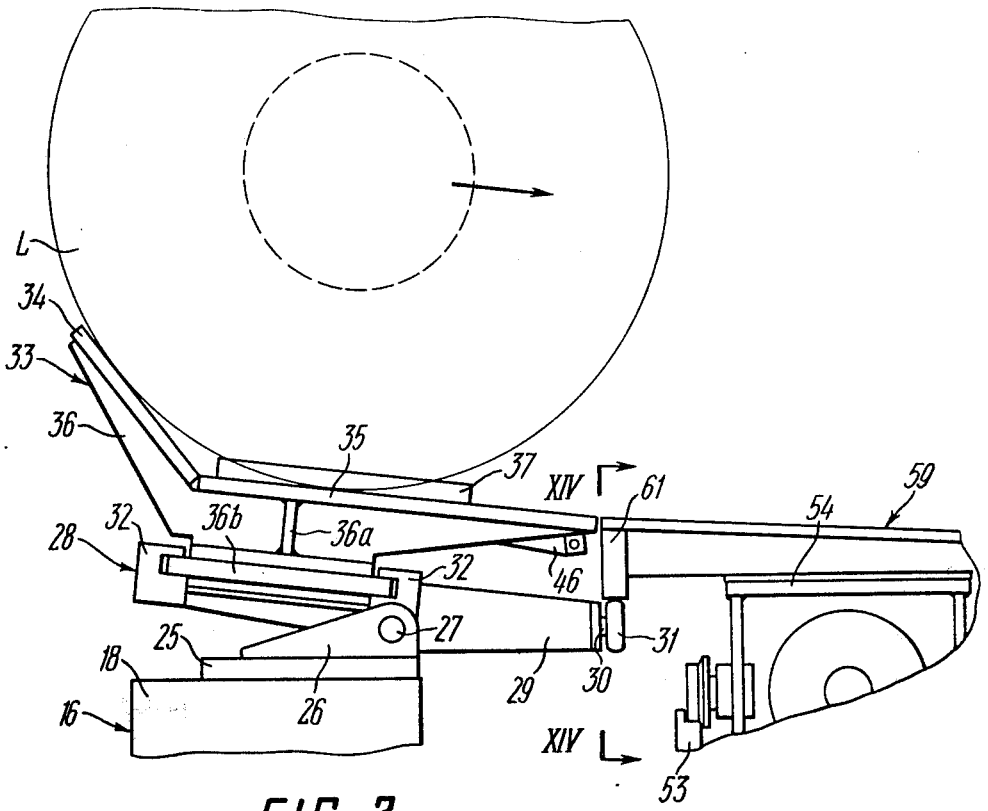
FIG. 3 is an enlarged detail of the area A in FIG. 2 illustrating the cooperation of the carriage roller with the cam of the receiving platform.

The top part of the carriage 16 (FIG. 3) is mounted to the bottom wall of the upper cup 18 outside thereof. The top part of the carriage 16 consists of three superposed plates. A first or bottom plate 25 is rigidly fixed to the bottom wall of the cup 18. This plate is provided with brackets 26 having holes receiving a pivot 27. A second or intermediate plate 28 is mounted on the plate 25 and is articulated thereto with one side thereof by means of the pivot 27. The pivot 27 is passed through a hole made in the intermediate plate 28 adjacent to an edge thereof (as shown in FIG. 3) to extend in parallel with the centers 4 and 5. Thus the plate 28 is rotatable in a vertical plane normal to the centers 4 and 5.

A bracket 29 is rigidly fixed to the end face of the intermediate plate 28 on the side of the pivot 27. The free end of the bracket supports an axle 30 having a roller 31.

Guide members 32 are mounted on the intermediate plate 28 adjacent to the edges thereof extending in parallel with the pivot 27. A third plate 33 adapted to accommodate the spool L is mounted in the guide members. The plate 33 is made V-shaped with an obtuse angle at the vertex. The plate is formed of two plates 34 and 35, and two V-shaped ridges 36 are welded in parallel with one another to the edges of the plates 34, 35. The ridges are spaced apart and interconnected by transverse ridges 36*a* (as shown in FIG. 3).

A plate 36*b* is welded to the ridges 36 from beneath in parallel with the plate 35, and the plate 36*b* is mounted with the parallel edges thereof in the guide members 32.

A bar 37 is fixed to the plate 35 adjacent to the edge thereof on the side of the movable centers 4, the bar extending normally to the centers and to the guide members 32 as shown in FIGS. 1 and 3. The bar 37 is designed for locking the position of the spool L on the top plate 33.

In addition, the top plate 33 is provided with means 38 (FIG. 1) for locking the position of the top plate relative to the intermediate plate 28. This means comprises two vertical rods 39 and 40 (FIG. 4) having identical diameters which are mounted in the followng manner.

A cup 41 is rigidly fixed to the lower side of the plate 28 adjacent to the edge thereof, and a rod 40 is mounted in the cup 41 and extends in a hole made in the plate 28 coaxially with the cup 41. The rod 40 is axially loaded by a compression spring 42 located between the lower end thereof and the bottom wall of the cup 41. The plate 33 has a projection 43 of rectangular shape located above the cup 41. The projection 43 has two holes "D" and "E" of a diameter corresponding to the diameter of the rods 39 and 40.

Figure 5:
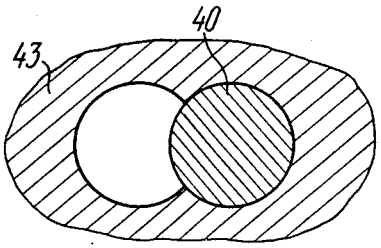
FIG. 5 is an enlarged sectional view taken along the line V—V in FIG. 4.

The hole "E" is a blind hole and is coaxial with the rod 40 to receive the upper end thereof, and the hole "D" is a through hole. The distance between the centers of the holes "D" and "E" is greater than one-half the diameter thereof but smaller than the whole diameter as shown in FIG. 5. The rod 39 is axially movable in the through hole "D" (FIG. 4) and is supported with lower end thereof by the upper end of the rod 40. A plate 44 is rigidly fixed to the upper end of the rod 39 to extend in a plane normal to the rod axis, and the plate 44 is mounted in a groove "C" of the upper end of the projection 43. The depth of the groove "C" is equal to the amount of axial displacement of the rod 39 with the plate 44 with the allowance for the thickness of the plate.

A bolt 45 extending in a through vertical hole of the projection 43 adjacent to the hole "D" functions as a stop limiting vertical displacements of the plate 44. The bolt is screwed in the plate 44, and the bolt head bears with the underside surface against the bottom of the blind hole "E".

The top plate 33 is provided with a rotatable spring-loaded stop 46 (FIG. 1) for fixing the spool L on the plate 33.

Figure 6:
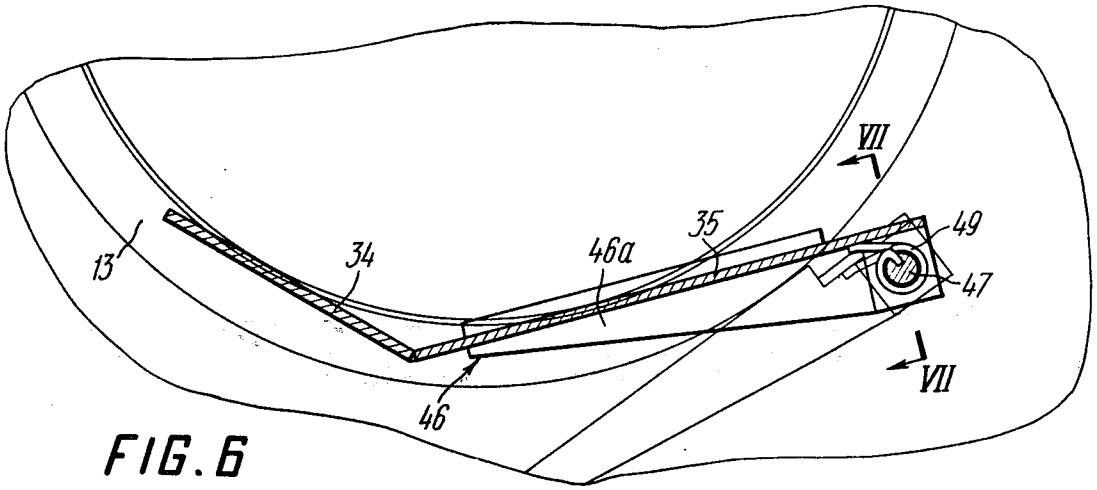
FIG. 6 is an enlarged sectional view taken along the line VI—VI in FIG. 1.

The stop 46 is mounted on the underside of the plate 35 (FIG. 6) of the top plate 33 adjacent to the edge thereof facing the fixed center 5 (FIGS. 6 and 1).

Figure 7:
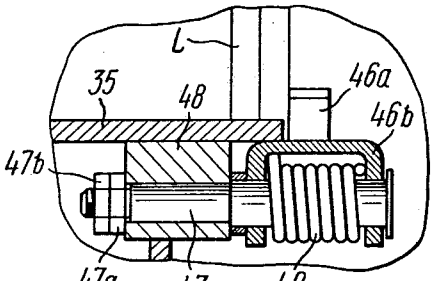
FIG. 7 is an enlarged sectional view taken along the line VII—VII in FIG. 6.

The stop 46 comprises a flat lever 46*a* which has a C-shaped latch 46*b* (FIG. 7) bent in a plane normal to the plane of the lever 46*a*. The latch 46*b* is fixed to the lever 46*a* with the intermediate portion thereof. The bent ends of the latch 46*b* have holes receiving one end of a pivot 47. The other end of the pivot 47 extends in a hole of a projection 48 and is rigidly fixed by means of a nut 47*a* and a lock nut 47*b* as shown in FIG. 7. A torsion spring 49 is mounted on the pivot 47 between the bent ends of the latch 46*b*. One end of the spring bears against the inner side of the intermediate portion of the latch 46*b* and the other end of the spring is fixed to the pivot 47.

One end of a drawbar 50 is rigidly fixed to the free end of each of the movable centers 4 (FIG. 1). The drawbar extends parallel to the axis of the center 4 and comprises a round-section bar. The drawbar 50 extends in holes of the base 2 used as guides therefor. The free end of the drawbar 50 has a stop 51 comprising a block bearing against the plate 44 (FIG. 4) when the top part of the carriage 16 is in the uppermost position. Thus, a force transmitting connection is provided between each of the movable centers 4 and the top plate 33 of the carriage 16.

A horizontally extending hydraulic cylinder 52 is mounted between the guides 17 (FIG. 2) for displacing the carriage 16.

Figure 8:
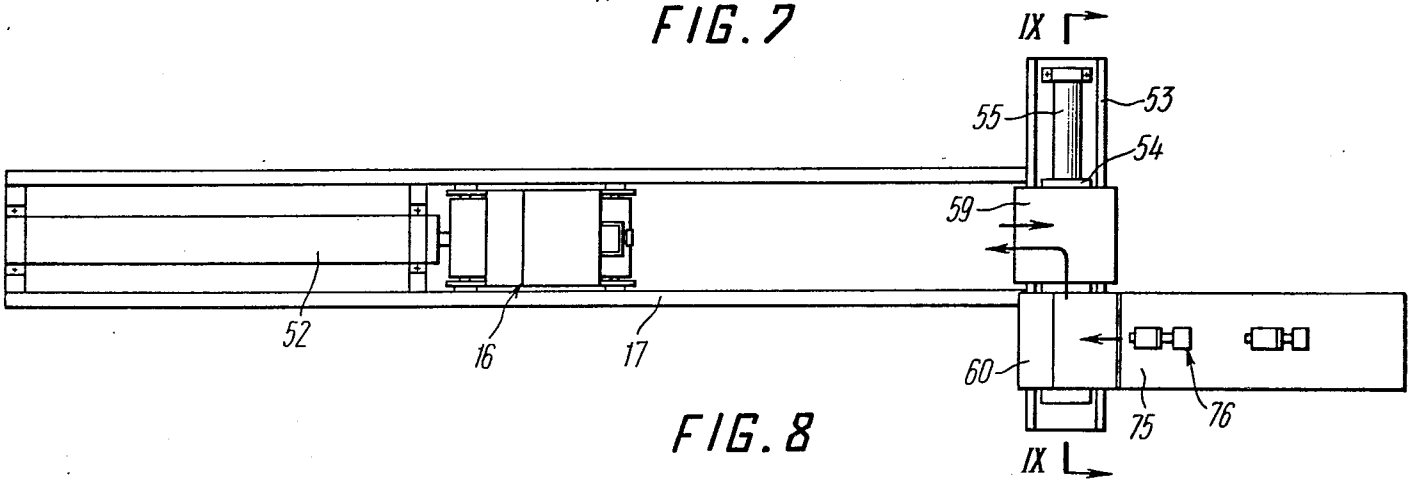
FIG. 8 is a diagrammatic plan view of a device for feeding spools to and removing them from the centers also showing receiving, feeding and accumulating platforms.

Guides 53 are mounted on the foundation 1 at the end of the guides 17 to extend to parallel with the centers 4 and 5 as shown in FIG 8. A slide block 54 (FIG. 9) of U-shaped cross-section is mounted in the guides 53. The slide block is mounted for reciprocation in the guides 53 (FIG. 8) by means of a hydraulic cylinder 55 mounted along guides 53.

The free end of a piston rod 56 of the hydraulic cylinder 55 extends in a hole made in the forward end wall of the slide block 54. A washer 57 is mounted on the free end of the piston rod 56, and a compression spring 58 is mounted between the washer and the forward end wall of the slide block. A receiving platform 59 and a feeding platform 60 are mounted on the slide block 54. The receiving platform comprises a welded plate 59*a* having ridges which is rigidly fixed to the slide block 54 in an inclined position sloping away from the guides 17 so that the spools L can roll down from the platform 59.

A cam 61 for cooperation with the roller 31 of the carriage 16 is rigidly fixed to the underside of the plate 59*a* adjacent to the edge thereof facing the carriage 16 (FIG. 3).

The feeding platform 60 (FIG. 10) is adapted to accommodate the spool L.

The feeding platform is made V-shaped with an obtuse angle at the vertex and consists of two welded plates 62, 63 and two V-shaped ridges welded to the plates 62, 63 from beneath. The ridges are spaced apart at a distance about equal to the width of the plates 62, 63. Reinforcement ridges are also provided between the ridges 64 (not shown in FIG. 10).

Figure 9:
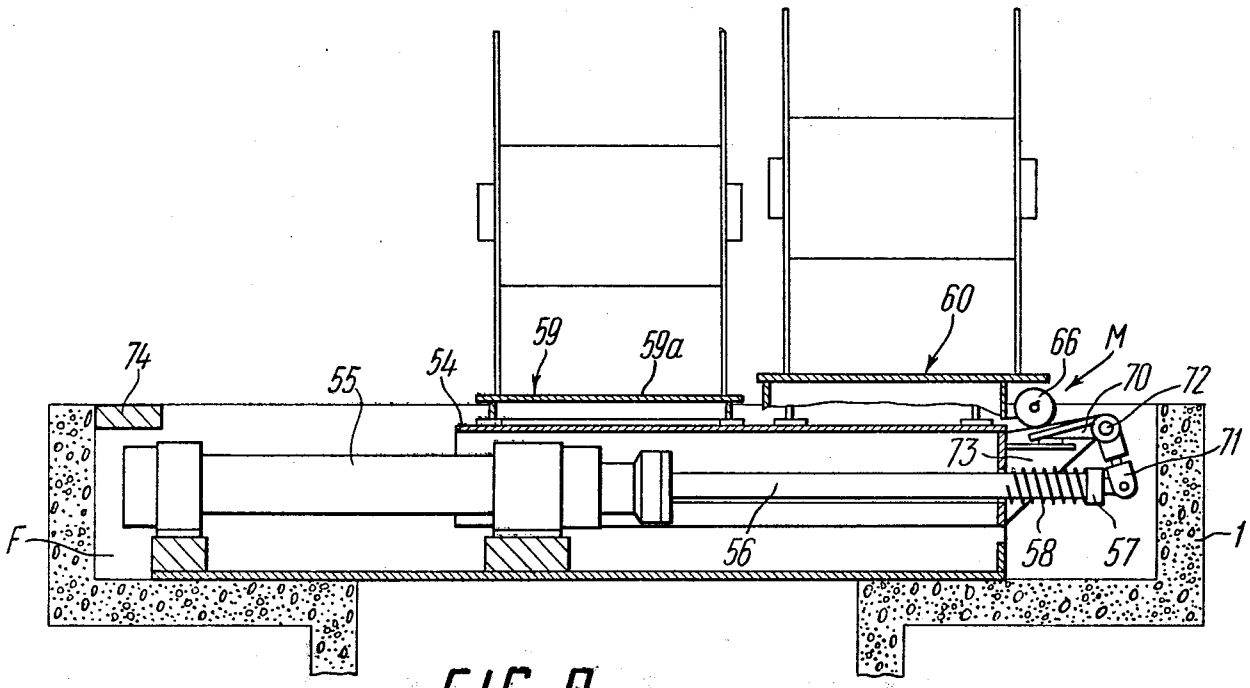
FIG. 9 is an enlarged sectional view taken along the line IX—IX in FIG. 8.
Figure 10:
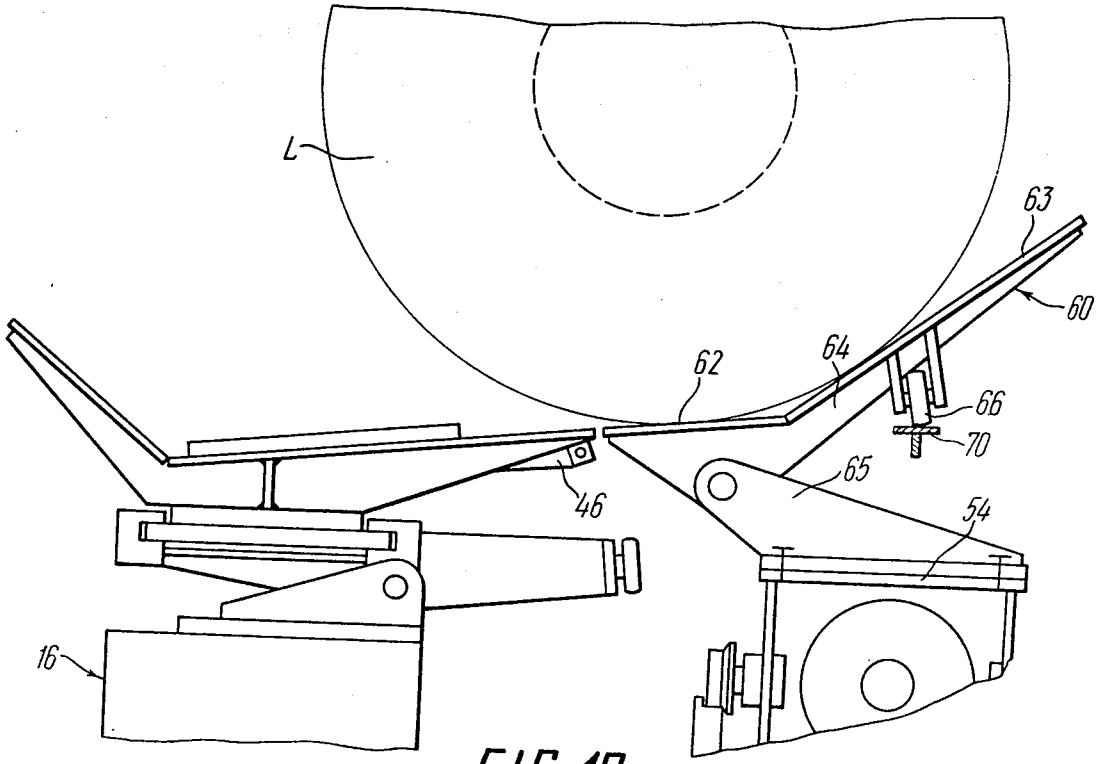
FIG. 10 is an enlarged detail of the area A in FIG. 2 illustrating the cooperation of the carriage roller with the feeding platform.
Figure 11:
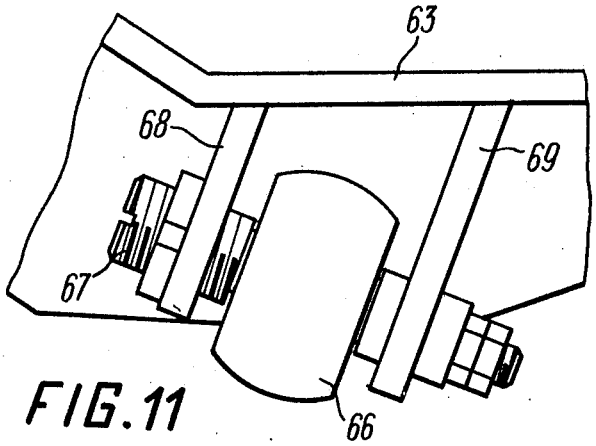
FIG. 11 is an enlarged view taken in the direction of the arrow M in FIG. 9.

The slide block 54 is provided with brackets 65, and the feeding platform 60 is articulated to the brackets 65 at the ridges 64. As shown in FIG. 9 and 10, a roller 66 is mounted on the feeding platform 60. The roller 66 is mounted on an axle 67 (FIG. 11) which is fixed with the ends thereof in brackets 68, 69 secured to the underside of the plate 63 adjacent to the edge thereof facing the free end of the piston rod 56 of the hydraulic cylinder 55 (FIG. 9).

The feeding platform 60 is in a force transmitting connection with the piston rod 56 of the hydraulic cylinder 55.

This force transmitting connection is provided via the roller 66, a lever 70 cooperating with the roller 66 and a connecting rod 71 telescopically connected to the lever 70 and articulated to the free end of the piston rod 56. The lever 70 is mounted on a pivot 72 secured to a bracket 73 of the slide block 54.

The guides 53 with the slide block 54 and the hydraulic cylinder 55 are mounted in the recess of the foundation 1 so that the receiving platform 59 is located at the floor level "K".

As shown in FIG. 9, a stop 74 is mounted on the rear wall of the recess F to limit the displacement of the slide block 54 along the guides 53.

As shown in FIG. 8, an accumulating platform 75 is mounted at the right hand side of the feeding platform 60 in an inclined position sloping towards the feeding platform 60. The accummulating platform 75 has holding means 76 for holding empty spools L.

The holding means 76 may be of any appropriate known construction.

The apparatus for continuous winding of filament on spools functions in the following manner.

Two empty spools L are arranged in the pairs of movable cneters 4 and fixed centers 5 (FIG. 1).

Filament passed through the traversing mechanism 7 is fixed to one of the spools L, e.g. to the left hand spool. Then the drive of the movable center 4 of the left hand pair is put on, and the spool L starts rotating.

The filament is wound on the left hand spool L. The traversing mechanism 7 guides the filament to lay it in parallel rows on the spool.

After a predetermined length of the filament is wound on the spool L, a signal for acceleration of the second, right hand spool L is fed. At the same time, the filament transfer mechanism 6 is displaced to the extreme right position along the guides 10 by means of the screw-and-nut mechanism 11.

The traversing mechanism 7 feeds the filament to the disc 13 of the right hand pair of centers 4 and 5.

The filament feeding mechanism 15 mounted adjacent to the disc 13 feeds the filament in the known manner to the filament engagement mechanism 14. The filament is engaged by the right hand disc 13 and is concurrently broken at the left hand spool L. The filament is then fixed to the right hand spool L, and the winding to this spool begins, while the loaded left hand spool is stopped.

The carriage 16 is displaced from the extreme right position to be placed under the loaded spool L.

The top part of the carriage 16 is lifted. The stop 46 is urged by the disc 13 and lowered.

Figure 4:
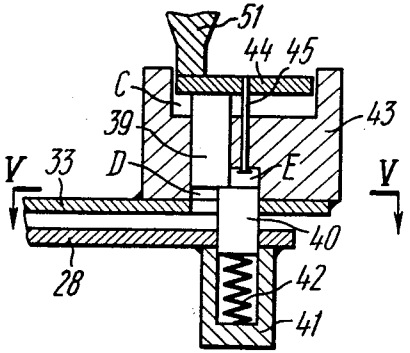
FIG. 4 is an enlarged detail of the area B in FIG. 1 in a first position.

The plate 44 engages the stop 51 (FIG. 4) of the drawbar 50. Under the action of the stop 51 the plate 44 is lowered to be urged, with the rod 39, against the spring-loaded rod 40. The rod 40 leaves the hole "E". As a result, the plate 33 can now move along the guide members 32 relative to the intermediate plate 28, and the stop 51 will take the extreme left position as shown in FIG. 4. This is accomplished by means of any appropriate known automatic control system.

Figure 12:
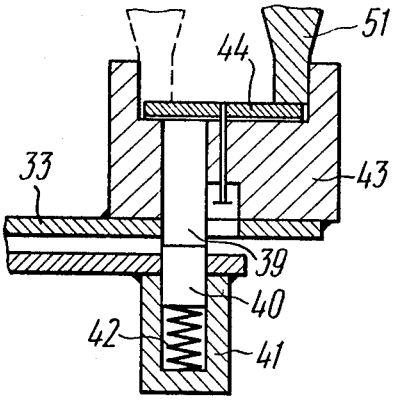
FIG. 12 is a view similar to FIG. 4 illustrating a second position.

Then a signal for retraction of the movable center 4 (FIG. 1) is fed. The spool L is lowered down with the cheek "1" thereof facing the movable center 4 is lowered onto the bar 37. By that moment the stop 51 of the drawbar 50 is the extreme right positon (as shown in FIG. 12).

The stop 51 bears against the wall of the groove "C" and entrains with it the top plate 33. The spool L (FIG. 1) supported with the cheek "1" thereof the bar 37 is withdrawn from the fixed center 5 and lowered with the other cheek "1" onto the top plate 33.

Then the top part of the carriage 16 is lowered. The rotatable stop 46 (FIG. 6) is lifted by the spring 49 to lock the position of the spool L on the top plate 33.

Figure 13:
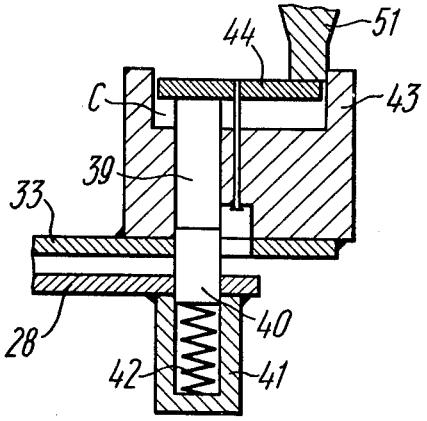
FIG. 13 is a view similar to FIG. 12 with the top plate in a locked position relative to the intermediate plate.

At that moment, the rod 40 is lifted by the spring 42 (FIG. 12) to be received in the hole "D" of the top plate 33 as shown in FIG. 13 thereby locking the position of the top plate.

The carriage 16 (FIG. 3) is displaced to the extreme right position, and the top part thereof is lifted. The roller 31 bears against the cam 61 of the receiving platform 59. Thus the intermediate plate 28 is rotated about the pivot 27, and the loaded spool L rolls down from the top plate 33 to the receiving platform 59.

At that moment the holding means 76 (FIG. 8) releases an outer empty spool L which rolls down along the inclined accumulating platform 75 to the feeding platform 60.

Then a signal is fed to the hydraulic cylinder 55 which displaces, with its piston rod 56, the slide block 54 towards the carriage 16.

Figure 14:
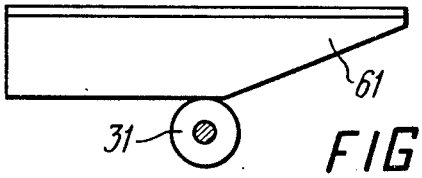
FIG. 14 is an enlarged sectional view taken along the line XIV—XIV in FIG. 3.

The cam 61 (FIG. 14) leaves the roller 31, and the plate 33 is rotated into the initial position.

The slide block 54 reaches the stop 74 and is stopped. The feeding platform 60 is stopped opposite the carriage 16.

The piston rod 56 continues to move to the left in the plane of the FIG. 9 to compress the spring 58 (the force of the spring 58 is greater than that required to displace the slide block 54) and to rotate the lever 70 and the connecting rod 71 telescopically connected thereto.

The lever 70 is rotated to bear against the roller 66 and to tilt the feeding platfrom 60.

The empty spool L is transferred to the top plate 33 of the carriage 16.

The top part of the carriage 16 is lowered, and then the carriage is displaced toward the free pair of centers 4 and 5.

After the carriage 16 is stopped under the free pair of centers 4 and 5, the top part of the carriage is lifted at an amount sufficient to bring the axis of the spool L to stop somewhat lower than the axis of the centers 4 and 5 of said pair.

The rotatable stop 46 (FIG. 1) cooperates with the peripheral surface of the disc 13 and is lowered.

The plate 44 engages the stop 51 of the drawbar 50.

The plate 44 is lowered under the action of the stop 51 (FIG. 12) to press with the rod 39 against the spring-loaded rod 40. The rod 40 leaves the hole "D" of the plate 33 which is now released.

Then a signal is fed to displace the movable center 4 towards the spool L. The stop 51 (FIG. 12) of the drawbar 50 is also displaced towards the spool L (to the left hand side in the plane of the drawing).

The stop 51 bears against the wall of the groove "C" to displace the plate 33 together with the empty spool L towards the fixed center 5. The spool L is thus mounted in the centers 4 and 5.

The top part of the carriage 16 is lowered, and the carriage 16 is displaced to the right hand centers.

The process of the removal of the loaded spool L and feeding of an empty spool L to the centers 4 and 5 is repeated as described above.

What is claimed is:

1. An apparatus for continuous winding of filament on spools comprising: a winder means; pairs of centers each consisting of a movable center and a fixed center for parallel arrangement of spools, said pairs of centers being incorporated in said winder means; a traversing mechanism of said winder means; a mechanism of said winder means for transferring filament from one spool to another; a device for feeding spools to and removing them from the centers, said device being in a force transmitting connection with said winder means; a carriage of said device for feeding spools to and removing them from the centers, said carriage having a top part and a bottom part; guides, said bottom part of the carriage being mounted in the guides, the guides extending under and normally to the centers; the bottom part of said carriage being made vertically split; the top part of said carriage consisting of three superposed plates of which a first plate is mounted on the bottom part of said carriage, an intermediate plate is articulated with a side thereof to the first plate for rotation in a vertical plane extending parallel with said guides of the carriage and supports guide members extending parallel with the pivot of the articulation for mounting a third plate which is used for accommodating the spools and is in a force transmitting connection with one of the movable centers when the part of the carriage is in the uppermost position; means for locking the position of the third, top plate of the carriage relative to the intermediate plate thereof; a feeding platform for feeding an empty spool to said carriage; a receiving platform for receiving a loaded spool from said carriage.

2. An apparatus according to claim 1, wherein the bottom part of the carriage is made composite and consists of two vertical cups received in each other with the open ends thereof for relative axial reciprocations, the lower cup being mounted in guides, and the first plate of the top part of the carriage being rigidly fixed to the bottom wall of the upper cup.

3. An apparatus according to claim 2, wherein the axial displacement of the cups of the bottom part of the carriage is effected by means of a hydraulic cylinder mounted therein, the housing of the hydraulic cylinder being mounted to the bottom wall of the lower cup, and the free end of a piston rod is fixed to the bottom wall of the upper cup.

4. An apparatus according to claim 1, wherein said means for locking the position of the third plate relative to the intermediate plate comprises two vertical rods of which a first rod is mounted in a cup fixed to the intermediate plate and axially urged by a spring toward the third plate, and the second rod extends in a hole made in a projection of the third plate and cooperates, with the lower end, with the upper end of the first rod, a plate being fixed to the upper end of the second rod and is received in a groove made in the upper end of said projection.

5. An apparatus according to claim 1, wherein the third, plate of the top part of the carriage is made V-shaped and formed of two plates rigidly interconnected by means of two V-shaped ridges, and a stepped bar is fixed adjacent to an edge of one of the plates to extend normally to the guides in which the third plate is mounted.

6. An apparatus according to claim 1 wherein the force transmitting connection between the third plate of the carriage and each of the movable centers is provided by means of a drawbar having one end thereof fixed to the movable center and the other end bearing against a plate of said means for locking the position of the third plate of the carriage relative to the intermediate plate.

7. An apparatus according to claim 1, wherein the third plate of the carriage is provided with a rotatable spring-loaded stop for fixing the spool on the third plate during the transfer.

8. An apparatus according to claim 1, wherein the intermediate plate is provided, for rotation thereof, with a roller cooperating with a cam fixed to the receiving platform.

9. An apparatus according to claim 1, wherein the receiving platform is stationary mounted on a slide block, and the feeding platform is articulated to the slide block, the slide block being mounted for reciprocation in guides extending parallel to the centers.

10. An apparatus according to claim 9, wherein there is provided a hydraulic cylinder having a piston rod connected to the slide block to effect the reciprocation thereof in the guides, the piston rod being in a force transmitting connection with the feeding platform.

11. An apparatus according to claim 10, wherein the force transmitting connection between the piston rod of the hydraulic cylinder and the feeding platform is provided by means of a roller fixed to the feeding platform, as well as by means of a connecting rod articulated to the end of said piston rod an a lever articulated to the slide block which are telescopically connected to each other, the lever cooperating with said roller.

* * * * *